US007183883B2

(12) United States Patent
Kanno et al.

(10) Patent No.: US 7,183,883 B2
(45) Date of Patent: Feb. 27, 2007

(54) RF CIRCUIT COMPONENT AND RF CIRCUIT

(75) Inventors: Hiroshi Kanno, Osaka (JP); Kazuyuki Sakiyama, Shijonawate (JP); Ushio Sangawa, Ikoma (JP); Tomoyasu Fujishima, Neyagawa (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 11/231,806

(22) Filed: Sep. 22, 2005

(65) Prior Publication Data

US 2006/0022772 A1 Feb. 2, 2006

Related U.S. Application Data

(63) Continuation of application No. PCT/JP05/13385, filed on Jul. 21, 2005.

(30) Foreign Application Priority Data

Jul. 30, 2004 (JP) ..... 2004-223162

(51) Int. Cl.
*H01P 1/219* (2006.01)
*H01P 7/08* (2006.01)
*H01P 5/12* (2006.01)

(52) U.S. Cl. ..... 333/204; 333/134; 333/210

(58) Field of Classification Search ..... 333/202, 333/204, 209–210, 212, 219, 219.1, 134, 333/135

See application file for complete search history.

(56) References Cited

U.S. PATENT DOCUMENTS 4,593,460 A * 6/1986 Gannon et al. ..... 333/202
4,675,631 A * 6/1987 Waggett ..... 333/210
6,075,427 A * 6/2000 Tai et al. ..... 333/219
2002/0027483 A1 3/2002 Sasaki et al.

FOREIGN PATENT DOCUMENTS

| | | |
|---|---|---|
| JP | 62-186602 | 8/1987 |
| JP | 63-269802 | 11/1988 |
| JP | 6-25041 | 6/1994 |
| JP | 07-288406 | 10/1995 |
| JP | 11-308022 | 11/1999 |
| JP | 2001-257529 A | 9/2001 |
| JP | 2003-087005 A | 3/2003 |

OTHER PUBLICATIONS

"Microwave Solid State Circuit Design"; Wiley-Interscience; John Wiley & Sons, Inc.; pp. 28-33, 2003.

* cited by examiner

*Primary Examiner*—Seungsook Ham
(74) *Attorney, Agent, or Firm*—McDermott Will & Emery LLP

(57) ABSTRACT

An RF circuit component according to the present invention includes a waveguide 1 and at least one resonator 2, which is arranged inside the waveguide 1. The resonator 2 includes at least one patterned conductor layer, which is parallel to a plane that crosses an H plane, and resonates at a lower frequency than a cutoff frequency, which is defined by the internal dielectric constant, shape and size of the waveguide 1, thereby letting an electromagnetic wave, having a lower frequency than the cutoff frequency, pass through the inside of the waveguide 1.

14 Claims, 11 Drawing Sheets

RF CIRCUIT COMPONENT AND RF CIRCUIT

This Application is a continuation of International Application No. PCT/JP2005/013385, whose international filing date is Jul. 21, 2005, which in turn claims the benefit of Japanese Patent Application No. 2004-223162, filed on Jul. 30, 2004, the disclosures of which Applications are incorporated by reference herein. The benefit of the filing and priority dates of the International and Japanese Applications is respectfully requested.

BACKGROUND OF THE INVENTION

1. Field of the Invention

The present invention relates to a radio frequency (RF) circuit. More particularly, the present invention relates to an RF circuit component that can be used effectively for transmitting, demultiplexing, multiplexing, radiating or detecting an RF signal belonging to the microwave or millimeter wave band, and also relates to an RF circuit including such a circuit component.

2. Description of the Related Art

A waveguide is known as one of various transmission elements for an RF circuit. A waveguide is usually a structure made of a hollow tubular conductor in which electromagnetic fields of certain modes are formed in an internal space surrounded with the conductor. The waveguide allows the electromagnetic waves having a particular frequency to propagate. Examples of waveguides include rectangular waveguides having a rectangular cross section, and circular waveguides having a circular cross section, perpendicularly to the electromagnetic wave propagating direction (see Wiley-Interscience (John Wiley & Sons, Inc.), "Microwave Solid State Circuit Design", pp. 28–33.).

A typical structure for a rectangular waveguide will be described with reference to FIG. 12. The waveguide shown in FIG. 12 has a rectangular cross section, which has a vertical size of a mm and a horizontal size of b mm (where a<b). Every electromagnetic wave, having an effective wavelength that is at most twice as long as the horizontal size b, can transmit through the inside of this waveguide. However, no electromagnetic wave, having an effective wavelength that is more than twice as long as the horizontal size b, can transmit through it. In other words, the effective wavelength of the electromagnetic wave that can transmit through this waveguide is 2×b mm or less. The velocity c of the electromagnetic wave is represented by effective wavelength×frequency. Thus, the cutoff frequency fc is given by c/(2×b). As a result, electromagnetic waves, of which the frequencies are equal to or lower than the cutoff frequency fc, are cut off.

A rectangular waveguide may also be used as an antenna. FIG. 13 shows a structure for a rectangular waveguide that functions as an antenna. The waveguide shown in FIG. 13 includes an input portion 31 at one end thereof and an aperture plane 32 at the other end thereof. An electromagnetic wave with a predetermined frequency is input through the input portion 31, transmitted through the inside of the waveguide, and then radiated into a free space through the aperture plane 32. In this case, a frequency corresponding to an effective wavelength of 2×b, which is twice as long as the horizontal size b of the input portion 31, becomes the cutoff frequency fc. Accordingly, the antenna shown in FIG. 13 can radiate or receive an electromagnetic wave having a frequency exceeding this cutoff frequency fc.

To realize desired radiation directivity, the horizontal size b1 and vertical size a1 of the aperture plane 32 may be respectively different from the horizontal size b and vertical size a of the input portion 31.

A slot antenna is known as an antenna, of which the structure is similar to that of the rectangular waveguide antenna shown in FIG. 13. FIG. 14(*a*) is a perspective view of a slot antenna structure, and FIG. 14(*b*) is a cross-sectional view thereof as viewed on the plane 26.

The slot antenna structure shown in FIG. 14 includes a dielectric substrate 21 with a grounded conductor layer 23 provided on its back surface. A strip-shaped slot 24 is cut through a center portion of the grounded conductor layer 23. The slot 24 is formed by removing a conductor portion of the grounded conductor layer 23 all through its thickness in its own designated area. On the surface of the dielectric substrate 21, a signal conductor line 22 is arranged so as to cross the slot 24 of the grounded conductor layer 23. A microstrip line is defined by this signal conductor line 22 and the grounded conductor layer 23 such that an electromagnetic wave propagates through the microstrip line. In this case, resonance is caused at an effective wavelength that is twice as long as the horizontal width of the slot 24. When the resonance is set up, an electromagnetic wave is radiated through the slot 24 into the free space under the back surface of the dielectric substrate 21. Only an electromagnetic wave, having a frequency close to the frequency at which resonance is caused by the slot 24 (i.e., the resonant frequency), is radiated efficiently into the free space.

A waveguide is used not just as an antenna but also as an RF circuit in various other applications. Japanese Patent Application Laid-Open Publication No. 62-186602 and Japanese Patent Application Laid-Open Publication No. 63-269802 disclose bandpass filters including a waveguide as one of its elements.

As described above, the frequency of an electromagnetic wave that a waveguide can transmit is higher than the cutoff frequency fc. For example, to make a waveguide that passes an electromagnetic wave at 2 GHz, the horizontal size b of the waveguide needs to be at least equal to 7.5 cm. This is because a waveguide with a horizontal width shorter than 7.5 cm would have a cutoff frequency fc higher than 2 GHz and a 2 GHz electromagnetic wave could not be transmitted through the waveguide. That is why if one tried to use such a waveguide in an RF circuit to operate in a frequency range of around 2.4 GHz, then its size would be too big, which is a problem.

However, if a waveguide is loaded with a material with a high dielectric constant, then the cutoff frequency fc of the waveguide can be reduced and the size of the waveguide can also be reduced accordingly.

Hereinafter, the cutoff frequency fc of the waveguide will be described in further detail with reference to FIGS. 15(*a*) and 15(*b*). FIG. 15(*a*) is a graph schematically showing how the transmission intensity of a waveguide, including the air inside, changes with the frequency. On the other hand, FIG. 15(*b*) is a graph schematically showing how the transmission intensity of a waveguide, which is loaded with a high dielectric material, changes with the frequency.

As can be seen from FIGS. 15(*a*) and 15(*b*), no electromagnetic waves can be transmitted at frequencies lower than the cutoff frequency fc. It can also be seen that the cutoff frequency fc can be reduced by loading the waveguide with the high dielectric material. The cutoff frequency fc is inversely proportional to the $0.5^{th}$ power of the dielectric constant. Accordingly, if the waveguide is loaded with a high dielectric material with a dielectric constant of 9, for example, then the cutoff frequency fc can be reduced to one-third ($=1/9^{0.5}=1/3$). This means that by loading the waveguide with the high dielectric material with a dielectric constant of 9, the effective wavelength of the electromagnetic wave inside the waveguide 1 shortens to one-third.

However, even if a waveguide with a horizontal size b of 3 mm is loaded with such a high dielectric material with a dielectric constant of 9, the cutoff frequency fc can be just reduced from 50 GHz to 16.7 GHz and no electromagnetic waves with a frequency of about 2 GHz can be transmitted, either. To transmit an electromagnetic wave with a frequency of about 2 GHz, the horizontal size b needs to be further increased about eightfold. The same statement applies to an antenna or a slot antenna using a waveguide.

Consequently, as long as the conventional waveguide structure is adopted, even a waveguide with as small a horizontal size as 10 mm or less could not transmit an electromagnetic wave with a frequency of 5 GHz or less.

Each of Japanese Patent Application Laid-Open Publication Nos. 62-186602 and 63-269802 discloses that by arranging a dielectric resonator inside a waveguide, the waveguide can also function as a bandpass filter. However, as schematically shown in FIG. 15(*c*), the frequency range in which the transmission intensity is increased by the action of the dielectric resonator is still higher than the reduced cutoff frequency fc shown in FIG. 15(*b*). That is why even if the conventional technique disclosed in Japanese Patent Application Laid-Open Publication Nos. 62-186602 or 63-269802 is used, the size of the waveguide cannot be further reduced compared to the situation where the waveguide is fully loaded with a high dielectric material.

SUMMARY OF THE INVENTION

In order to overcome the problems described above, a primary object of the present invention is to provide an RF circuit that can transmit an electromagnetic wave with a lower frequency through a smaller waveguide than a conventional one.

An RF circuit component according to the present invention includes a waveguide and at least one resonator, which is arranged inside the waveguide. The resonator includes at least one patterned conductor layer, which is parallel to a plane that crosses an H plane, and resonates at a lower frequency than a cutoff frequency, which is defined by the internal dielectric constant, shape and size of the waveguide, thereby letting an electromagnetic wave, having a lower frequency than the cutoff frequency, pass through the inside of the waveguide.

In one preferred embodiment, the resonator has a resonant frequency that is lower than the cutoff frequency.

In this particular preferred embodiment, the resonant frequency of the resonator is equal to or lower than a quarter of the cutoff frequency.

In another preferred embodiment, the at least one resonator is a plurality resonators.

In this particular preferred embodiment, the resonators have mutually different resonant frequencies.

In another preferred embodiment, the patterned conductor layer includes at least one of a spiral conductor line, a partially notched ringlike conductor line, a spiral slot, and a partially notched ringlike slot.

In this specific preferred embodiment, the resonator operates as a half-wavelength resonator or a quarter-wavelength resonator.

In an alternative preferred embodiment, the at least one patterned conductor layer is a plurality of conductor layers, which are stacked one upon the other and cross-coupled together.

In that case, the resonator has either a stacked spiral resonator structure or a stacked spiral conductor resonator structure.

In yet another preferred embodiment, the at least one patterned conductor layer is a plurality of conductor layers, the conductor layers are stacked one upon the other, and two adjacent ones of the conductor layers have spiral shapes that turn in mutually opposite directions.

In yet another preferred embodiment, the at least one resonator is a plurality resonators, which are arranged in the waveguide so as to face mutually different directions.

In this particular preferred embodiment, at least one of the resonators is arranged such that the patterned conductor layer thereof becomes parallel to a plane other than the H plane of the waveguide.

In yet another preferred embodiment, the waveguide has a pair of opposed metal walls, and the pair of metal walls is connected together via a conductive member.

An RF circuit according to the present invention includes more than one RF circuit component of any of the preferred embodiments described above. The RF circuit components include a first RF circuit component that transmits an electromagnetic wave at a first frequency and a second RF circuit component that transmits an electromagnetic wave at a second frequency, which is different from the first frequency. The RF circuit multiplexes together electromagnetic waves with the first and second frequencies or demultiplexes an electromagnetic wave into two waves with the first and second frequencies, respectively.

Another RF circuit according to the present invention includes the RF circuit component of any of the preferred embodiments described above. The waveguide included in the RF circuit component functions as an antenna for radiating or receiving an electromagnetic wave.

Still another RF circuit component according to the present invention performs at least one of the operations of radiating and receiving an electromagnetic wave. The RF circuit component includes a dielectric substrate with a surface and a back surface, and a grounded conductor layer, which is provided on at least one of the two surfaces of the dielectric substrate. A slot is cut through the grounded conductor layer so as to have a size that is smaller than a size that satisfies resonance conditions at the transmission frequency of the electromagnetic wave. At least one resonator is arranged inside or near the slot. The resonator has a lower resonant frequency than that of the slot.

An analyzer according to the present invention includes the RF circuit component of any of the preferred embodiments described above and a sensor connected to the RF circuit component. The sensor senses an electromagnetic wave that has been received by the RF circuit component.

An RF circuit according to the present invention can transmit a low-frequency electromagnetic wave through a waveguide that has a much smaller cross-sectional area than a conventional one, and can have a reduced size.

In addition, an RF circuit according to the present invention significantly attenuates a transmitted electromagnetic wave at any frequency but the resonant frequency of the resonator, and therefore, can also function as a bandpass filter with high frequency selectivity.

Also, an analyzer according to the present invention can reduce the size of its waveguide, functioning as an electromagnetic wave probe, and therefore, can exhibit increased position sensing resolution. Furthermore, even if the size of the waveguide is reduced, the sensing efficiency does not decrease.

BRIEF DESCRIPTION OF THE DRAWINGS

FIG. 2(*b*) shows a planar layout for the conductor line 101 included in the resonator.

FIG. 2(*c*) shows a planar layout for the conductor line 102 included in the resonator.

FIG. 4(*b*) shows a planar layout for the conductor line 104 included in the resonator.

FIG. 4(*c*) shows a planar layout for the conductor line 105 included in the resonator.

FIG. 5(*b*) shows a planar layout for the conductor lines 104 and 105 included in the resonator.

FIG. 15(*b*) is a graph schematically showing how the transmission intensity of a waveguide, loaded with a high dielectric material inside, changes with the frequency.

FIG. 15(*c*) is a graph schematically showing how the transmission intensity of a waveguide, in which dielectric resonators are arranged, changes with the frequency.

FIG. 15(*d*) is a graph schematically showing how the transmission intensity of a waveguide according to the first preferred embodiment of the present invention changes with the frequency.

DETAILED DESCRIPTION OF PREFERRED EMBODIMENTS

Embodiment 1

Figure 1:
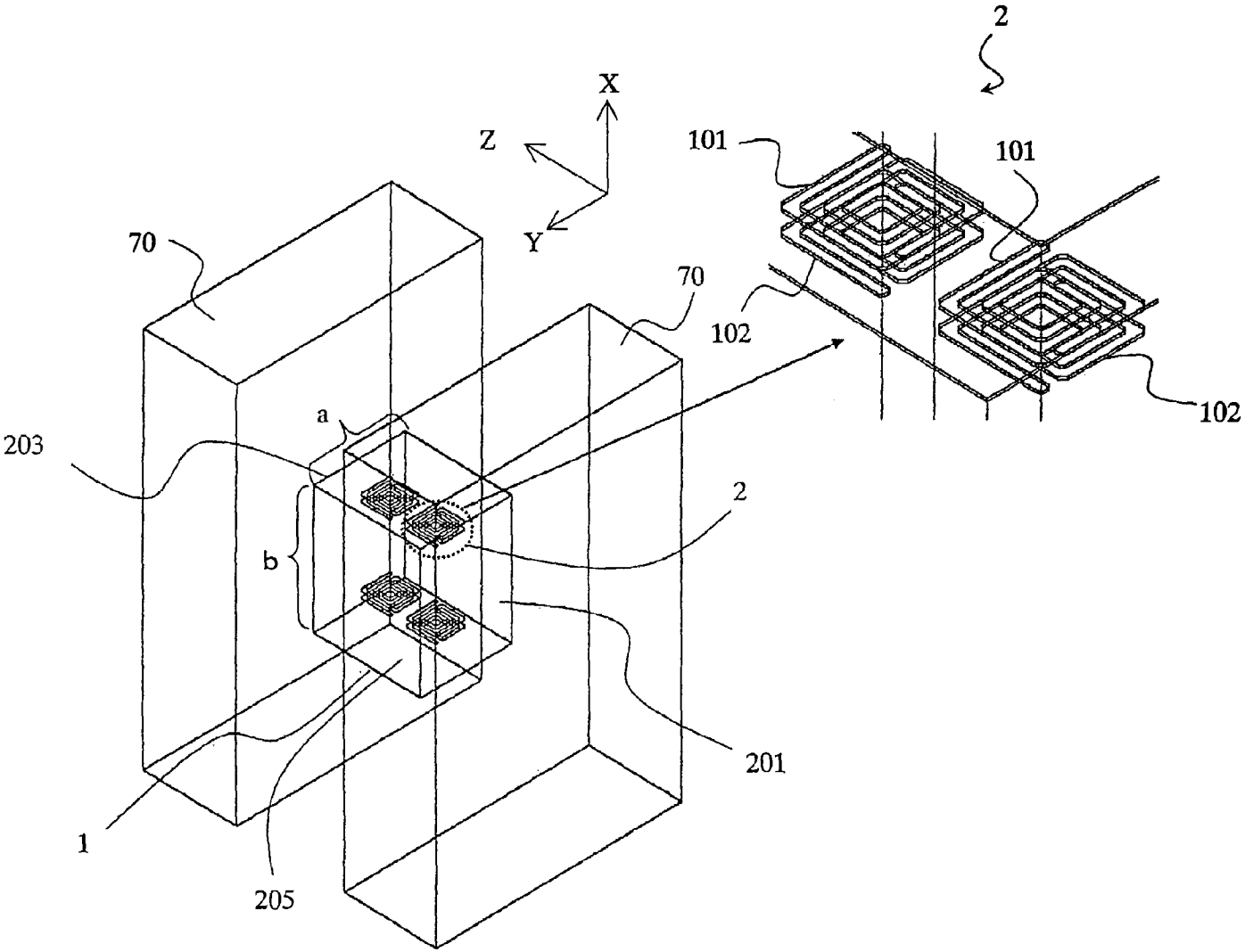
FIG. 1 illustrates a first preferred embodiment of an RF circuit according to the present invention.

Hereinafter, a first specific preferred embodiment of an RF circuit component according to the present invention will be described with reference to FIG. 1. The RF circuit component of this preferred embodiment shown in FIG. 1 includes a waveguide 1 and a plurality of resonators 2, which are arranged inside the waveguide 1. Input/output portions 70 are arranged on both sides of the waveguide 1. As will be described in detail later, each resonator 2 includes at least one patterned conductor layer (e.g., conductor lines 101, 102). By adjusting the shape and arrangement of this conductor layer, resonances can be caused at lower frequencies than the "cutoff frequency fc" that is defined by the waveguide 1, and electromagnetic waves with lower frequencies than the cutoff frequency fc can pass the waveguide 1. FIG. 1 also illustrates some resonators 2 on a larger scale, where the conductor lines 101 and 102 are illustrated as if those lines were transparent such that it can be seen how the conductor lines 101 and 102 overlap each other.

As used herein, the "cutoff frequency fc" is a frequency fc defined by the internal dielectric constant, shape and size of the waveguide 1 in which no resonators 2 are included, and electromagnetic waves with lower frequencies than that frequency fc should be unable to propagate through the inside of the waveguide 1. According to this preferred embodiment, however, the resonators 2 cause resonance at lower frequencies than the cutoff frequency fc, thereby transmitting those electromagnetic waves with such frequencies that should otherwise prevent those waves from propagating through the inside of the waveguide 1.

The frequency of an electromagnetic wave that can be transmitted through the inside of the waveguide 1 will be referred to herein as a "transmission frequency". In a conventional waveguide, the "transmission frequency" is always higher than the "cutoff frequency fc". According to the present invention, however, the transmission frequency is lower than the cutoff frequency fc.

FIG. 15(*d*) schematically shows how the transmission intensity of the waveguide 1 of this preferred embodiment changes with the frequency. As can be seen from FIG. 15(*d*), at a frequency lower than the cutoff frequency fc (i.e., at a transmission frequency f1), the transmission intensity of an electromagnetic wave rises steeply. More specifically, by loading the waveguide 1 with a high dielectric material, the transmission frequency f1 can be made even lower than the reduced cutoff frequency fc (see FIG. 15(*d*)). This transmission frequency f1 is close to the resonant frequency f0 of the resonator 2 arranged inside the waveguide 1.

Hereinafter, the configuration of the RF circuit component of this preferred embodiment will be described more fully.

As shown in FIG. 1, the waveguide 1 has an input plane 201 for receiving an externally incoming electromagnetic wave and an output plane 203 for passing an outgoing electromagnetic wave. In the waveguide 1 of this preferred embodiment, the input plane 201 and output plane 203 are parallel to each other. An electromagnetic wave, falling within a particular wavelength range, enters the waveguide 1 through the input plane 201, passes through the waveguide 1, and then leaves the waveguide 1 through the output plane 203. Thus, the direction perpendicular to the input and output planes 201 and 203 will be referred to herein as a "propagation direction" or "transmission direction". In the XYZ coordinate system shown in FIG. 1, the Z-axis is parallel to the propagation direction and the input and output planes 201 and 203 are parallel to the XY plane.

It should be noted that the input and output planes 201 and 203 are symmetrical to each other. Thus, when entering the waveguide 1 through the output plane 203, the electromagnetic wave falling within a particular wavelength range also passes through the waveguide 1 and then leaves the waveguide 1 through the input plane 201. That is why these two planes 201 and 203 do not have to be treated as different types but may be called "input/output planes" collectively. No members that interfere with the propagation of electromagnetic waves are arranged on the input/output planes 201 and 203, which can therefore be connected to another waveguide or any other RF circuit component (not shown). In this preferred embodiment, the two input portions 70, having a similar structure to the waveguide 1, are connected to the waveguide 1 via the input/output planes 201 and 203.

In the exemplary arrangement shown in FIG. 1, four resonators 2 are arranged inside the waveguide 1. However, the number of resonators 2 that can be used in one waveguide 1 does not have to be four. Each of the resonators 2 is designed so as to have a size that is big enough to arrange it inside the waveguide 1 and yet resonates at a resonant frequency f0 that is lower than the cutoff frequency fc described above. A more specific configuration of the resonator 2 that needs to resonate at such a low frequency for its size will be described in detail later.

The inside of the waveguide 1 shown in FIG. 1 is substantially a rectangular parallelepiped and has a rectangular cross section as viewed on a plane that is perpendicular to the Z-axis (i.e., the propagation direction). In the following description, each "cross section" is supposed to be viewed on a plane that is perpendicular to the Z-axis (i.e., the propagation direction) unless stated otherwise. Also, the inner space of the waveguide 1 is supposed to have a Y-axis size of a mm and an X-axis size of b mm, where a<b is satisfied.

The body of the waveguide 1 is preferably made of a resin, a metal or any other suitable material. However, at least the inner walls thereof need to be made of a material with electrical conductivity, which is typically a metal and preferably gold or copper, for example. If the inner walls of the waveguide 1 are coated with some metallization layer such as a plating layer, then the conductor layer (or the plating layer) may have a thickness of about 5 μm. The thickness of the conductor layer on the inner walls is set sufficiently greater than the skin depth at the transmission frequency f1.

The waveguide 1 is loaded with a solid dielectric material (such as a resin) 205 with a dielectric constant ∈. The dielectric material 205 also achieves the function of fixing and holding the resonators 2 inside the waveguide 1. The dielectric constant ∈ of the dielectric material 205 is higher than the dielectric constant (of approximately one) of the air. Thus, the inner space of the waveguide 1 has an increased dielectric constant. The higher the dielectric constant of the inner space of the waveguide 1, the shorter the effective wavelength. As a result, the size of the waveguide 1 can be further reduced. As the dielectric material 205, a known resin or ceramic, which is used extensively as a material for an RF circuit board, may be adopted. It should be noted that the waveguide 1 does not always have to be loaded with a special dielectric material but may be filled with the air, too. However, if the waveguide 1 is loaded with a non-solid dielectric material, then the resonators 2 are preferably fixed to the waveguide 1 by some members.

In this preferred embodiment, a<b is satisfied and therefore, the "electric field" of the electromagnetic wave propagating through the inside of the waveguide 1 is parallel to the YZ plane and the "magnetic field" of the electromagnetic wave is parallel to the XZ plane. That is why a plane parallel to the YZ-plane will be referred to herein as an "E plane" and a plane parallel to the XZ plane will be referred to herein as an "H plane".

In this case, the zero point of the Z-axis is set such that the Z coordinates of the input and output planes 201 and 203 have the same absolute value but mutually opposite signs. Also, the zero points of the X- and Y-axes are defined such that the Z-axis passes the respective centers of the input and output planes 201 and 203. As a result, two inner walls of the waveguide 1 that are parallel to the XZ plane (i.e., H planes) have Y coordinates of ±a/2 and the other inner walls of the waveguide 1 that are parallel to the YZ plane (i.e., E planes) have X coordinates of ±b/2.

In this preferred embodiment, the cutoff frequency fc determined by the size b of the waveguide 1 is set sufficiently higher than the transmission frequency f1 and the resonant frequency f0 of the resonators 2 (see FIG. 15(*d*)). Hereinafter, this point will be described in detail.

First, the size b corresponds to a half of the effective wavelength of an electromagnetic wave at the cutoff frequency fc. If the cutoff frequency fc is higher than the transmission frequency f1, then an effective wavelength corresponding to the cutoff frequency fc is sufficiently shorter than an effective wavelength corresponding to the transmission frequency f1. That is to say, the size b is set smaller than a half of the effective wavelength corresponding to the transmission frequency f1.

The transmission frequency f1 is close to the resonant frequency f0 of the resonators 2, which is low although the resonators 2 are small. That is to say, if the resonant frequency f0 of the resonators 2 can be set sufficiently lower than the cutoff frequency fc, the size b of the waveguide 1 can be much smaller than that of the conventional waveguide to achieve the same transmission frequency f1. In order to cause resonance responsive to an electromagnetic wave with a long effective wavelength in spite of their small size, the resonators 2 need to have a special structure as will be described below.

Figure 2A:
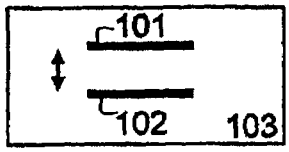
FIG. 2(*a*) is a cross-sectional view of a stacked spiral conductor resonator that can be used effectively as a resonator 2 according to the first preferred embodiment.
Figure 2B:
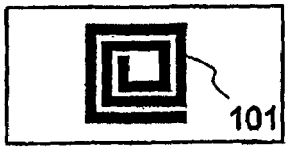
Figure 2C:
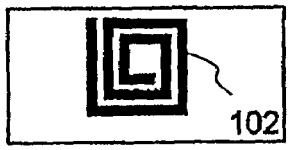

Hereinafter, the structure of the resonators 2 will be described. FIG. 2(*a*) illustrates the cross-sectional structure of the resonators 2. As shown in FIG. 2(*a*), each resonator 2 of this preferred embodiment includes a first conductor line 101 and a second conductor line 102, which are stacked one upon the other while being spaced from each other by a predetermined distance. FIGS. 2(*b*) and 2(*c*) illustrate the planar layouts of the first and second conductor lines 101 and 102, respectively. Each of the first and second conductor lines 101 and 102 is a part of a conductor layer that has been patterned so as to have a spiral shape. The first and second conductor lines 101 and 102 are coupled together by a capacitive cross coupling, thereby forming a single resonator structure. That is why a resonator with such a structure will sometimes be referred to herein as a "stacked spiral conductor resonator". This stacked spiral conductor resonator has a small size but can resonate at a low frequency. A resonator with such a structure is disclosed by the applicant of the present application in U.S. patent application Ser. No. 10/969,096 with Laid-open Publication No. 2005/0077993.

In the resonator 2 shown in FIG. 2, the first and second conductor lines 101 and 102 are coupled together by the capacitive cross coupling described above and can function as a parallel coupled line in which those lines 101 and 102 are coupled as distributed constants. Accordingly, if current flows through one of the first and second conductor lines 101 and 102 (e.g., through the first conductor line 101), then current will flow in the same direction through the other line (e.g., through the second conductor line 102). The latter current induces current in the same direction in the original conductor line (e.g., the first conductor line 101). As a result, the resonant wavelength of the resonator 2 becomes much greater than those of the conductor lines 101 and 102. That is to say, a resonance phenomenon can be brought about as if a space having a higher dielectric constant or permeability than that of the space 103 where the conductor lines 101 and 102 are arranged were being created.

In this preferred embodiment, the resonators 2 with such a configuration are adopted, and therefore, resonances can be set up inside the waveguide 1 shown in FIG. 1 in response to an electromagnetic wave having an effective wavelength that is sufficiently longer than the size b. However, the conductor layer of such resonators 2 does not have to have the spiral conductor line pattern but may have any of various other shapes as will be described later. For example, the conductor layer may have a shape with an opening that defines a slot.

Figure 3:
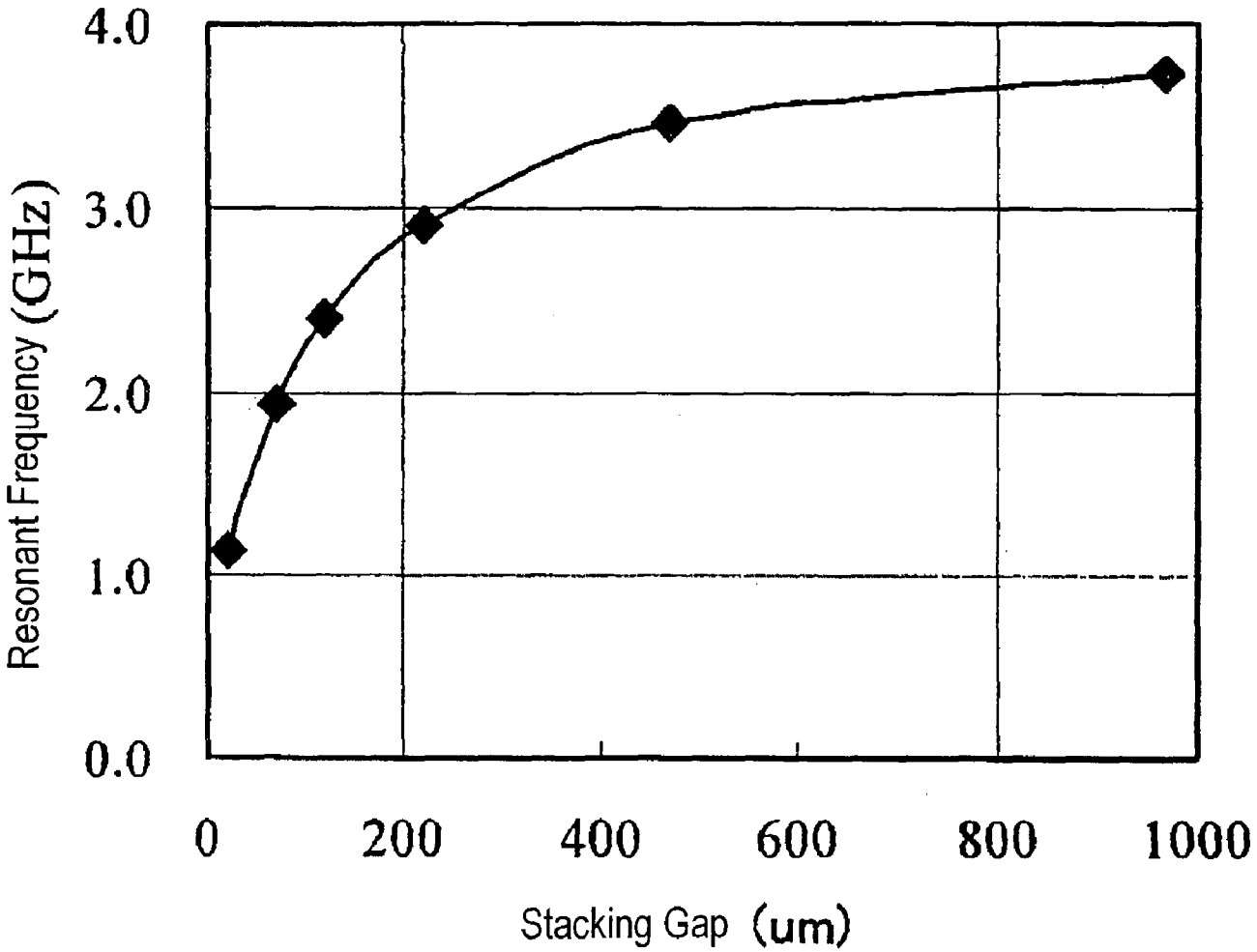
FIG. 3 is a graph showing how the resonant frequency of the stacked spiral conductor resonator changes with the stacking gap.

FIG. 3 is a graph showing how the resonant frequency (i.e., the lowest-order fundamental resonant frequency) changes with the gap between the conductor lines 101 and 102 that are stacked one upon the other in the resonator 2. The data shown in this graph was collected about a resonator 2 having the configuration shown in the following Table 1:

TABLE 1

| | |
|---|---|
| Dielectric constant of space 103 | 10.2 |
| Line width of conductor lines 101, 102 | 200 μm |
| Minimum line-to-line spacing between conductor lines 101, 102 | 200 μm |
| Thickness of conductor lines 101, 102 | 20 μm |
| Material of spiral conductor lines | Gold (Au) |
| Number of times of spiral turns | 2 |
| Directions of spiral turns | Opposite |

As can be seen from FIG. 3, as the stacking gap is narrowed, the resonant frequency of the resonator 2 can be reduced. If a single spiral conductor line of the same shape was made to cause resonance without stacking two such conductor lines one upon the other, its resonant frequency was 4.6 GHz. Thus, it can be seen that by stacking a plurality of spiral conductor lines one upon the other and by reducing the stacking gap, a resonator 2 with a significantly reduced resonant frequency can be obtained.

By arranging such resonators 2 inside the waveguide 1, the effective dielectric constant and permeability of the inner space of the waveguide 1 can be increased at the resonant frequency. This is because the effective dielectric constant and effective permeability increase in the resonance mode in which current flows in the same direction through the two stacked spiral conductor lines.

In this preferred embodiment, by using the resonators 2 with such a structure, electromagnetic waves, of which the frequencies would be cut off by a waveguide with the conventional structure unless the size of the waveguide were increased, can be transmitted even without increasing the size. More specifically, electromagnetic waves, of which the frequencies are a quarter or less (preferably, one-tenth or less) of the cutoff frequency fc defined by the size b of the waveguide, can pass the waveguide. In other words, supposing the transmission frequency remains the same, the size b of the waveguide can be reduced to a quarter or less (preferably one-tenth or less). Among frequencies currently applied to RF circuits, the present invention is particularly effectively applicable to the frequency range of 1 MHz to 100 GHz.

Either just one resonator 2 or a plurality of resonators 2 may be arranged inside a single waveguide 1. However, if two or four resonators 2 are arranged, then there is no need to increase the size of the waveguide 1 excessively and the effects of the present invention are achieved sufficiently. The resonant frequency f0 of the resonators 2 is preferably set either equal to, or close to, the transmission frequency f1.

The respective resonators 2 may resonate either at the same frequency or mutually different frequencies. The resonators 2 do not have to be arranged inside the waveguide 1 but may also be located in the vicinity of the input/output planes 201 and 203 of the waveguide 1. By arranging a plurality of resonators 2 in series, in parallel, or at random, those resonators 2 can be coupled together and desired effects can be achieved. And if the number or arrangement pattern of the resonators 2 is adjusted, then the transmission frequency can have a range with a predetermined width.

The number of layers of the spiral conductor lines that form each resonator 2 does not have to be two but may be three or more. By stacking an increased number of spiral conductor lines one upon the other, an even lower resonant frequency is achieved.

The effects of increasing the dielectric constant or permeability by making up each resonator of a stack of spiral conductor lines can also be achieved even if the spiral conductor lines are replaced with spiral slots. Also, those effects are achievable not just by stacking multiple spiral slots one upon the other but also by stacking spiral conductor lines and spiral slots one upon the other.

The conductor layer patterns that are stacked one upon the other to form the resonator 2 may be connected together via a conductor. By interconnecting the stack of conductor layer patterns via a conductor, the resonance phenomenon can be brought about at an even lower frequency. The space surrounding the conductor layer patterns is preferably filled with a material with a high dielectric constant. The dielectric constant or permeability of that material is preferably higher than that of the dielectric material with which the inside of the waveguide or the inside of the input/output portions of the waveguide is loaded. That material with a high dielectric constant or permeability may be present in at least a portion of the space between each pair of conductor layer patterns stacked. By making the resonator of such a material with a high dielectric constant or high permeability, the resonant frequency of the resonator can be further reduced.

To reduce the resonant frequency of the resonators 2, the spiral conductor lines to be stacked preferably turn in mutually opposite directions. However, those spiral conductor lines may turn in the same direction. The spiral conductor lines for use in the resonators 2 have a multilayer structure such as that shown in FIG. 2. Alternatively, the resonators 2 may also be formed even by arranging the spiral conductor lines on the same plane. In that case (i.e., if all of the spiral conductor lines are arranged on the same plane), the resonant frequency cannot be reduced sufficiently. Even so, a waveguide that transmits electromagnetic waves, of which the frequencies are lower than the conventional cutoff frequency fc, is still realizable.

The waveguide 1 shown in FIG. 1 has a rectangular profile. However, the waveguides that can be used in the present invention do not have to have the shape shown in FIG. 1. Rather an RF circuit component according to the present invention can also include a circular waveguide or a ridged waveguide, for example.

According to this preferred embodiment, the direction that the resonators face is determined such that the spiral conductor lines that form each resonator are not parallel to the H plane of the waveguide. That is to say, the resonator is arranged such that the conductor layers of the resonator cross a plane that is parallel to the H plane. To achieve the advantageous effects of the present invention, the resonators need to be coupled to the electromagnetic field within the waveguide. If the spiral conductor lines were parallel to the H plane of the waveguide, then a sufficient degree of coupling could not be obtained.

If a number of resonators are arranged inside the waveguide, those resonators do not have to be arranged regularly but may face random directions. This is because not all of the spiral conductor lines of those resonators should be parallel to the H plane.

Hereinafter, other arrangements of conductor lines in the resonator 2 will be described with reference to FIGS. 4 and 5. Each of the conductor lines to be described below has a ringlike shape with a notch (i.e., a gap portion), where both ends of the line face each other.

Figure 4A:
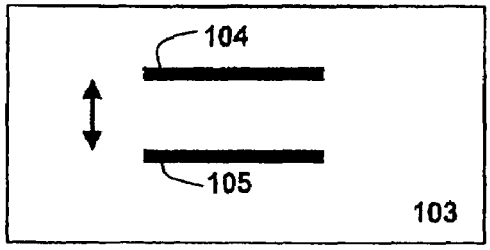
FIG. 4(*a*) is a cross-sectional view of another resonator that can be used effectively as a resonator 2 according to the first preferred embodiment.
Figure 4B:
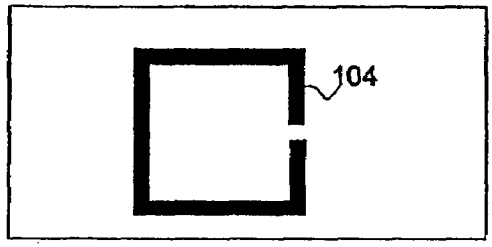
Figure 4C:
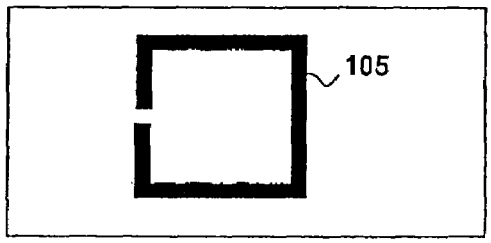

FIG. 4(*a*) schematically illustrates a cross section of a resonator in which two conductor lines 104 and 105 with such a configuration are stacked one upon the other. FIG. 4(*b*) shows a planar layout for the conductor line 104, while FIG. 4(*c*) shows a planar layout for the conductor line 105.

The conductor lines 104 and 105 function as rectangular ringlike resonators and are capacitively coupled together. When the dielectric material 103 had a dielectric constant of 10.2, the rectangular area had a length of 2 mm each side, and the lines had a width of 200 μm, a minimum spacing of 200 μm between the lines, a thickness of 20 μm, and a stacking gap of 150 μm, this resonator had a resonant frequency of 3.85 GHz.

As in the resonator shown in FIG. 2, current also flows in the same direction through the two stacked conductor lines of this resonator, thus increasing the effective dielectric constant of the parallel coupled lines. That is why if such a resonator is arranged inside a waveguide, then the effective dielectric constant in the inner space of the waveguide can be increased in the vicinity of the resonant frequency.

Figure 5A:
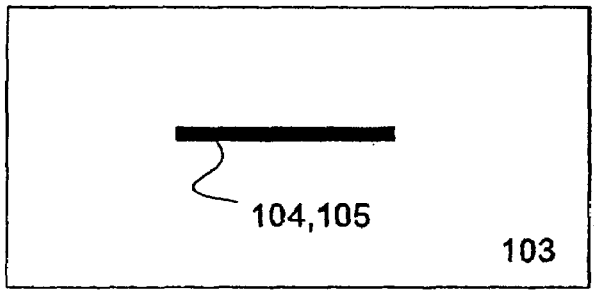
FIG. 5(*a*) is a cross-sectional view of still another resonator that can be used effectively as a resonator 2 according to the first preferred embodiment.
Figure 5B:
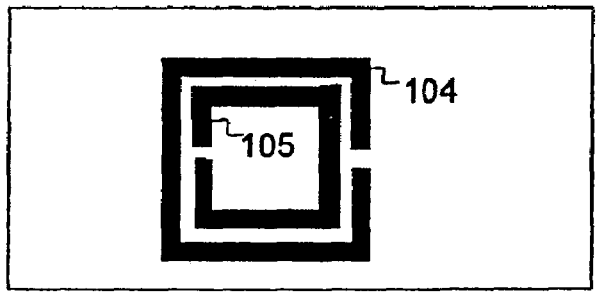

FIG. 5(*a*) illustrates a cross-sectional structure of another resonator in which conductor lines 104 and 105 are arranged on the same plane. FIG. 5(*b*) shows a planar layout for the conductor lines 104 and 105. When the dielectric material 130 had a dielectric constant of 10.2, the rectangular area had a length of 2 mm each side, and the lines had a width of 200 μm, a minimum spacing of 200 μm between the lines, and a thickness of 20 μm, this resonator had a resonant frequency of 5.8 GHz.

By making each conductor line of the resonator 2 longer than one side of the resonator 2 in this manner, the resonant frequency can be reduced without increasing the size of the resonator 2.

Optionally, one of the two spiral conductor lines that form the resonator 2 may have its open end connected to the inner wall of the waveguide such that the resonator 2 is short-circuited at its terminal. When short-circuited at its terminal, the resonator 2 can operate as a quarter-wavelength resonator. Otherwise, the resonator will function as a half-wavelength resonator.

In the example illustrated in FIG. 1, all of the four inner walls of the waveguide 1 are coated with conductor layers. In other words, the conductor layers on one pair of inner walls facing each other are electrically connected together via the conductor layers on the other pair of inner walls that crosses the former pair of inner walls at right angles. However, an RF circuit component according to the present invention does not have to have a waveguide with such a configuration. Alternatively, a waveguide with a rectangular cross section may also be formed by interconnecting a pair of parallel conductor layers using a conductor via structure. By adopting such a conductor via structure, a waveguide can be easily provided in a multilayer dielectric substrate. Also, if an inner wall conductor layer that faces the resonator arranged in the waveguide is replaced with such a conductor via structure, the Q value of the resonator can be increased and the pass loss thereof can be reduced.

An RF circuit component according to the present invention may also be used as an antenna. For example, by adopting an arrangement in which the output plane 203 of the waveguide 1 shown in FIG. 1 is opened to a free space, the RF circuit component of the present invention may operate as a small waveguide antenna.

Figure 6:
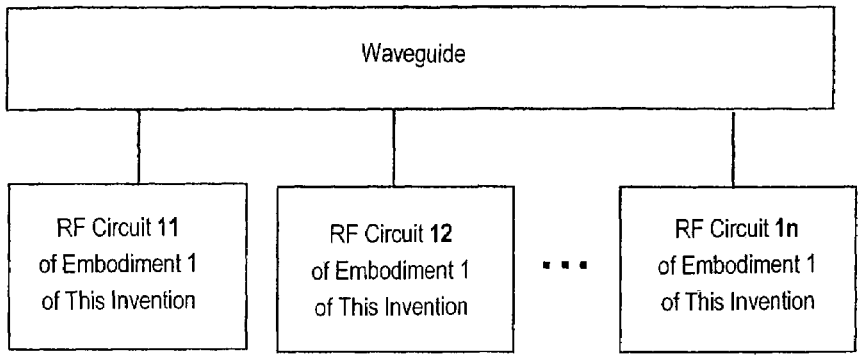
FIG. 6 schematically shows a configuration for a demultiplexer/multiplexer made up of the RF circuits of the first preferred embodiment.

A number n of RF circuit components 11, 12, . . . and 1*n* (where n is an integer that is equal to or greater than two), each having the configuration shown in FIG. 1, may be prepared and connected in parallel to a single waveguide as shown in FIG. 6. By setting the resonant frequencies f01, f02, . . . and f0*n* of the RF circuit components 11, 12, . . . and 1*n* to mutually different values, a multiplexer or demultiplexer can be provided.

Figure 7:
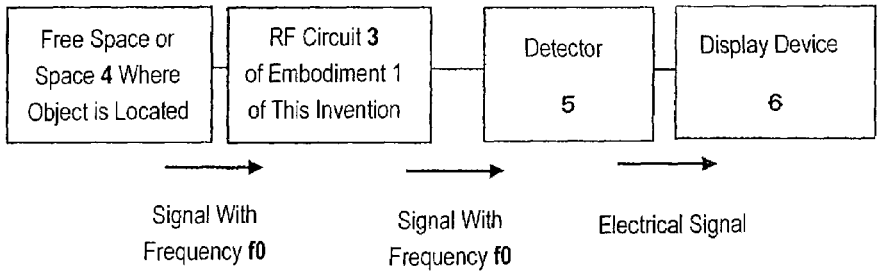
FIG. 7 schematically shows a configuration for an analyzer including the RF circuit component of the first preferred embodiment.

Furthermore, by using the RF circuit component shown in FIG. 1 as an antenna waveguide, an analyzer that can measure unwanted radiation from a very small circuit area can be provided. FIG. 7 is a block diagram showing a configuration for such an analyzer. As shown in FIG. 7, this analyzer includes the RF circuit component 3 of this preferred embodiment, one terminal of which is connected to either a free space or a space 4 where a circuit for radiating a signal with a predetermined frequency is arranged. This analyzer further includes a sensor 5 that is connected to the other terminal of the RF circuit component 3 and a display device 6 for displaying the output electrical signal of the sensor 5. On receiving a signal that has the same frequency as the resonant frequency f0 of the resonator 2 arranged in the waveguide, the sensor 5 converts that signal into an electrical signal and the outputs the signal.

Such an analyzer can appropriately measure an electromagnetic wave with the frequency f0, which has been radiated from a very small area in the space 4, because the RF circuit component 3 can have a reduced size.

EXAMPLE 1

Hereinafter, Examples Nos. 1-1 through 1-12 of an RF circuit component according to the present invention will be described with reference to FIG. 8.

Figure 8B:
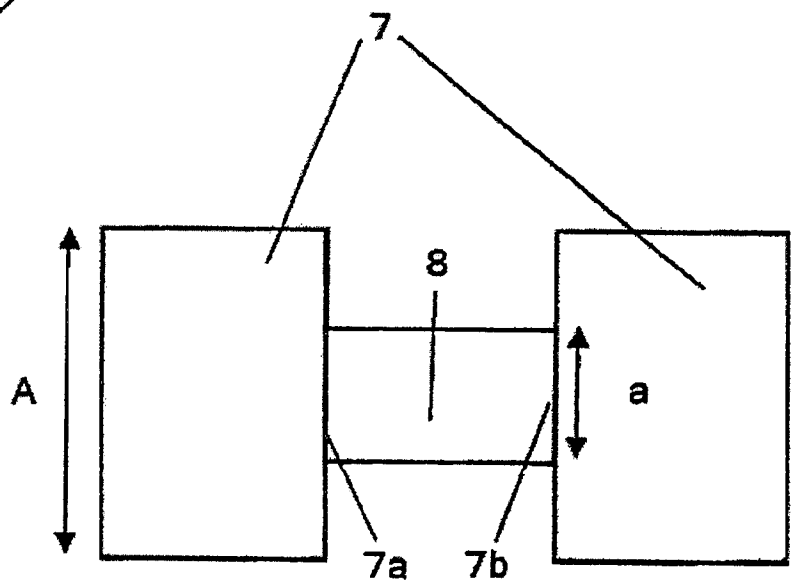
FIGS. 8(*a*) and 8(*b*) are respectively a perspective view and a side view illustrating the structure of an RF circuit according to a first example.
Figure 8A:
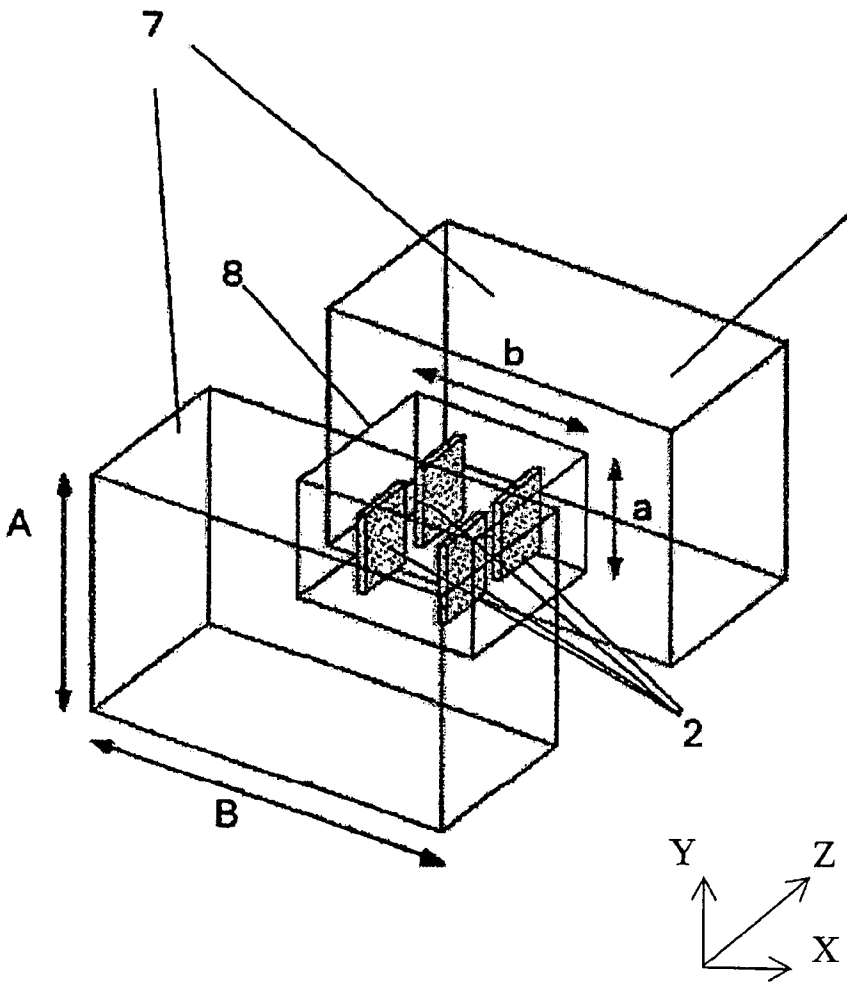

FIG. 8 illustrates a basic configuration for Examples Nos. 1-1 through 1-11. FIG. 8(*a*) is a transparent perspective view of this example and FIG. 8(*b*) is a side view thereof.

As shown in FIG. 8, the waveguide of each example includes two input/output portions 7 and a constricted portion 8 sandwiched between the input/output portions 7. The waveguide is made of a resin material with a dielectric constant of 10.2 and is designed such that the cross section of the constricted portion 8 at the center is smaller than the cross section of the input/output portions 7. The constricted portion 8 has a vertical size of a mm and a horizontal size of b mm, while the input/output portions 7 have a vertical size of A mm and a horizontal size of B mm. In Example No. 1-1, A was set to 25 mm and B was set to 32 mm.

In this case, an XYZ coordinate system, in which the vertical size, horizontal size and length of the waveguide are measured along the Y-, X- and Z-axes, respectively, is defined. Also, A<B and a<b are supposed to be satisfied for the sake of simplicity. A zero point of the Z-axis (where Z=0) is defined at the halfway point between the input/output planes 7*a* and 7*b* of the constricted portion 8. Thus, the input/output planes 7*a* and 7*b* have Z coordinates with the same absolute value and opposite signs.

In the input portion 7, the origin of the coordinate system (where X=Y=0) is defined at the center of the cross section of the waveguide such that the H boundary planes of the waveguide have Y coordinates of ±A/2 and the E boundary planes of the waveguide have X coordinates of ±B/2. In the same way, in the central constricted portion 8, the H boundary planes of the waveguide have Y coordinates of ±a/2 and the E boundary planes of the waveguide have X coordinates of ±b/2. It should be noted that every size is expressed in millimeter unit.

In each of the RF circuit components representing Examples Nos. 1-11 through 1-11, the input/output portions 7 of the waveguide are also loaded with a dielectric material with a dielectric constant of 10.2 as in the central constricted portion 8 thereof. Thus, the cutoff frequency fc defined by the value of the size B is 1.5 GHz.

The resonators 2 have the same structure as the resonators 2 of the first preferred embodiment described above. That is to say, the resonators 2 also had the parameter values shown in Table 1 and each pair of spiral conductor lines in two layers had a stacking gap of 150 μm. As a result, each resonator 2 had a resonant frequency of 2.1 GHz.

The constricted portion 8 of the waveguide has a vertical size a of 2.2 mm, a horizontal size b of 2.5 mm, and a length of 7 mm. The cutoff frequency fc of the constricted portion 8 was defined by the value of the size b and was 18.8 GHz. The resonant frequency of 2.1 GHz of the resonators 2 meets the cutoff conditions. More particularly, the resonant frequency of the resonators 2 is approximately one-ninth of the cutoff frequency fc.

In Example No. 1-1, a single resonator 2 was arranged at the center of the constricted portion 8 of the waveguide, where X=0. In this case, the direction of the resonator 2 was defined such that the stacked spiral conductor lines of the resonator 2 became parallel to the E planes.

Figure 9:
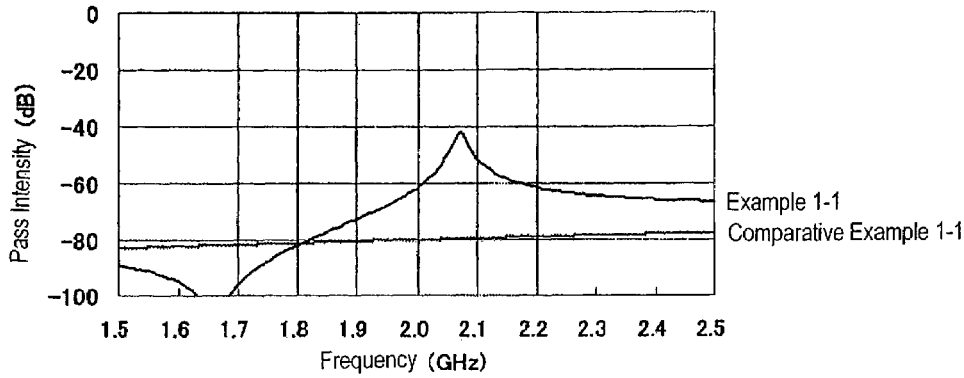
FIG. 9 shows the pass characteristics of Example No. 1-1 and Comparative Example No. 1-1 in the first preferred embodiment.

FIG. 9 shows the transmission characteristics of Example No. 1-1 and Comparative Example No. 1-1. The only difference between Comparative Example No. 1-1 and Example No. 1-1 is that Comparative Example No. 1-1 has no resonators 2.

As can be seen from FIG. 9, an attenuation of about 79 dB was always observed irrespective of the frequency in Comparative Example No. 1-1, while the attenuation decreased to about −42 dB at a frequency of around 2.08 GHz. That is to say, the waveguide representing Example No. 1-1 can transmit an electromagnetic wave with a frequency of around 2.08 GHz.

Next, Examples Nos. 1-2 and 1-3, in which a plurality of resonators 2 were arranged in series along the Z-axis, will be described. Each of the resonators 2 was arranged such that their spiral conductor lines would be parallel to the E planes.

The numbers of resonators 2 that were arranged in series in Examples Nos. 1-2 and 1-3 were two and three, respectively. In Example No. 1-2, the gap between the two adjacent resonators 2 was set to 1 mm. In Example No. 1-3 on the other hand, the gap between each pair of adjacent resonators 2 was set to 0.2 mm. In Example No. 1-3, two out of the three resonators, located at both ends of the constricted portion 8, partially stuck out from the constricted portion 8 into the input/output portions 7.

Figure 10:
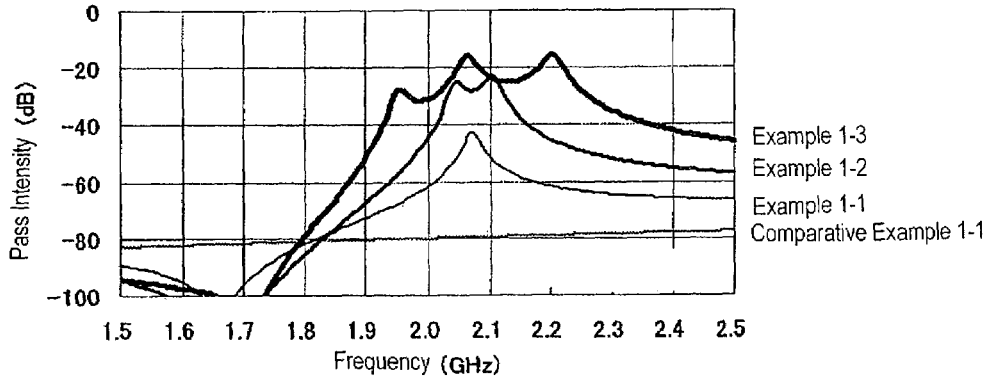
FIG. 10 shows the pass characteristics of Examples Nos. 1-1, 1-2 and 1-3 and Comparative Example No. 1-1 in the first preferred embodiment.

FIG. 10 shows the pass characteristics of Examples Nos. 1-2 and 1-3. As can be seen from FIG. 10, as a plurality of resonators 2 were coupled together inside the waveguide, the frequency range of the resonant frequency expanded and a broader pass band was realized. Also, the greater the number of resonators 2 coupled, the higher the maximum transmission intensity.

The configurations of Examples Nos. 1-1 through 1-3 and Comparative Example No. 1-1 and their characteristic values are shown in the following Table 2:

TABLE 2

| | b | Stacked spiral conductor resonator | | Pass characteristic | |
|---|---|---|---|---|---|
| | (mm) | # | Arrangement | Frequency | Transmission intensity |
| Ex. 1-1 | 2.5 | 1 | One pair of parallel conductors arranged in one column and one row | 2.08 GHz | −42 dB |
| Ex. 1-2 | | 2 | Two pairs of parallel conductors arranged in one column and two rows | 2.1 GHz | −23 dB |
| Ex. 1-3 | | 3 | Three pairs of parallel conductors arranged in one column and three rows | 2.06 GHz | −17 dB |
| Cmp. Ex. 1-1 | | 0 | — | 2.08 GHz | −79 dB |

In Example No. 1-1, even if the positions of the resonator 2 were changed from X=0 into X=1 or X=−1, a pass band was also obtained in a frequency range surrounding the resonant frequency of the resonator 2.

Furthermore, in Example No. 1-1, even if two resonators 2 were arranged in parallel at positions with X coordinates of 0.5 and −0.5 or even if three resonators 2 were arranged in parallel at positions with X coordinates of 1, 0 and −1, respectively, a pass band was also obtained in a frequency range surrounding the resonant frequency of the resonators 2.

Next, the transmission characteristic of Comparative Example No. 1-2 was evaluated. In Comparative Example No. 1-2, the resonators 2 of Example No. 1-2 were turned such that the spiral conductor lines, arranged parallel to the E planes (i.e., the YZ plane) in Example No. 1-2, would be parallel to the H planes (i.e., the XZ plane).

Specifically, in Comparative Example No. 1-2, two resonators 2 were arranged in series on the H plane with a Y coordinate of 0 and had Z coordinates of −2 and +2, respectively.

The transmission characteristic of Comparative Example No. 1-2 was similar to that of Comparative Example No. 1-1 in which no resonators 2 were arranged. In Comparative Example No. 1-3, the Y coordinate of the resonators 2 was changed from Y=0 in Comparative Example No. 1-2 into Y=1. However, the pass characteristic of Comparative Example No. 1-3 was no different from that of Comparative Example No. 1-2.

Next, Comparative Example No. 1-4, in which the resonators 2 were arranged in the same direction as the counterparts of Example No. 1-1 and in which the size b of the constricted portion 8 was increased to 5 mm, was prepared. In Comparative Example No. 1-4, two resonators 2 were arranged in parallel along the X-axis. In this Comparative Example No. 1-4, the resonators 2 were arranged such that the conductor layers of the resonators 2 would be parallel to the H planes and the transmission intensity did not increase.

The configurations and characteristics of Example No. 1-2 and Comparative Examples Nos. 1-2, 1-3 and 1-4 are shown in the following Table 3:

TABLE 3

| | b | Stacked spiral conductor resonator | | Effect of the |
|---|---|---|---|---|
| | (m) | # | Arrangement | invention |
| Example 1-2 | 2.5 | 2 | Parallel to E plane at center of waveguide cross section | Yes |
| Cmp. Ex. 1-2 | | 2 | Parallel to H plane at center of waveguide cross section | No |
| Cmp. Ex. 1-3 | | 2 | Parallel to H plane not at center of waveguide cross section | No |
| Cmp. Ex. 1-4 | 5 | 4 | Parallel to H plane, four pairs of parallel conductors arranged in two columns along X-axis | No |

Next, Example No. 1-4, in which three resonators 2 were arranged such that the conductor layers of each resonator 2 would be parallel to the XY plane, was prepared. Specifically, the three resonators 2 were arranged in series at three positions with Z coordinates of 1.5, 0 and −1.5, respectively. In Example No. 1-4, the transmission intensity at 2.05 GHz was −65 dB.

Next, Example No. 1-5, in which the constricted portion 8 had a horizontal size of 5 mm and in which six resonators 2 were arranged such that the conductor layers of each resonator 2 would be parallel to the XY plane, was prepared. Unlike Example No. 1-4, the six resonators 2 were arranged in two columns in this Example No. 1-5 such that each column included three resonators 2 arranged in series. In Example No. 1-4 in which the number of columns of the resonators 2 arranged in parallel was one, the transmission intensity was −65 dB. On the other hand, in Example No. 1-5 in which the number of columns of the resonators 2 arranged in parallel was two, the transmission intensity turned out to be −15 dB. The structures and characteristics of Examples Nos. 1-4 and 1-5 are shown in the following Table 4:

TABLE 4

| | b | Stacked spiral conductor resonator | | Pass characteristic | | Effect |
|---|---|---|---|---|---|---|
| | (mm) | # | Arrangement | Frequency | Transmission intensity | of the invention |
| Ex. 1-4 | 2.5 | 3 | XY plane, three pairs of parallel conductors arranged in one column and three rows | 2.08 GHz | −65 dB | Little |
| Ex. 1-5 | 5 | 6 | XY plane, six pairs of parallel conductors arranged in two columns and three rows | 2.1 GHz | −15 dB | much |

Next, Example No. 1-6 was prepared by replacing the small resonator 2 in the waveguide of Example No. 1-2 with spiral conductor lines arranged in a single layer. In Example No. 1-6, the transmission intensity was −19 dB at 3.5 GHz. An RF circuit component representing Comparative Example No. 1-1, obtained by removing the two spiral conductor lines arranged in series from Example No. 1-6, showed a transmission intensity of −70 dB at 3.5 GHz. The present inventors discovered that the beneficial effects of the present invention were achieved by this Example No. 1-6 compared to that Comparative Example No. 1-1. The following Table 5 shows the structures and characteristics of Example No. 1-6 and Comparative Example No. 1-1 in comparison. It should be noted that the frequency of the electromagnetic wave to pass in Example No. 1-6 was one-fifth or less of the cutoff frequency fc.

TABLE 5

| | b | Spiral conductor resonator | | Pass characteristic | |
|---|---|---|---|---|---|
| | (mm) | # | Shape | Frequency | Transmission intensity |
| Ex. 1-6 | 2.5 | 2 | Parallel to E plane, resonator consisting of two pairs of spiral conductor lines arranged in two rows | 3.5 GHz | −19 dB |
| Cmp. Ex. 1-1 | | 0 | — | 3.5 GHz | −70 dB |

Next, Example No. 1-7 was prepared by connecting the resonators 2, which were separately arranged inside the waveguide 1 of Example No. 1-2 without being connected to the inner walls of the waveguide, to the inner walls of the waveguide. Each resonator 2 of this Example No. 1-7 had its terminal short-circuited and was turned into a new small-sized resonator by directly connecting the outer open end of one of the two spiral conductor lines, forming parts of the resonator 2, to the inner walls of the waveguide. In Example No. 1-7, the transmission intensity was −29 dB at 1.8 GHz. An RF circuit component representing Comparative Example No. 1-1, obtained by removing the two resonators 2 arranged in series from Example No. 1-7, showed a transmission intensity of −80 dB at 1.8 GHz. The present inventors discovered that the beneficial effects of the present invention were achieved by this Example No. 1-7 compared to that Comparative Example No. 1-1. It should be noted that the frequency of the electromagnetic wave to pass in Example No. 1-7 was one-tenth or less of the cutoff frequency fc. The following Table 6 shows the structures and characteristics of Example No. 1-7 and Comparative Example No. 1-1 in comparison:

TABLE 6

| | b | Stacked spiral conductor resonator | | Pass characteristic | |
|---|---|---|---|---|---|
| | (mm) | # | Shape | Frequency | Transmission intensity |
| Ex. 1-7 | 2.5 | 2 | Parallel to E plane, arranged in two rows and short-circuited | 1.8 GHz | −29 dB |
| Cmp. Ex. 1-1 | | 0 | — | 1.8 GHz | −80 dB |

Next, Examples Nos. 1-8 through 1-11 were prepared by arranging no resonators 2 at all in the constricted portion 8 (where −3.5<Z<3.5) but arranging the resonators 2 only in the input/output portions 7 (where Z>3.5 and Z<−3.5) of the waveguide 1.

In Example No. 1-8, two resonators 2 were arranged at two positions with Z coordinates of 4.7 and −4.7, respectively, parallel to the E planes under the conditions including a=2.2 mm and b=2.5 mm. Each of the resonators 2 in the input and output portions included a single pair of conductor lines, which were arranged in one column and one row at a position where X=Y=0. In Example No. 1-8, the transmission intensity was −40 dB at 2.05 GHz. In the same way, in Example No. 1-9, the resonators 2, which were arranged at positions with an X coordinate of zero in Example No. 1-8, were shifted to where X=2. That is to say, no resonators 2 were arranged inside the projection plane of the constricted portion of the waveguide but the transmission intensity was −69 dB at 2.05 GHz. Similar effects of the present invention could be achieved until X reached about one-eighth of the effective wavelength. The following Table 7 shows the structures and characteristics of Examples Nos. 1-8 and 1-9 in comparison:

TABLE 7

| | b | Stacked spiral conductor resonator | | Pass characteristic | |
|---|---|---|---|---|---|
| | (mm) | # | Arrangement | Frequency | Transmission intensity |
| Ex. 1-8 | 2.5 | 2 | Parallel to E plane, one resonator arranged in each input/output portion where X = 0 and Y = 0 | 2.05 GHz | −40 dB |
| Ex. 1-9 | | 2 | Parallel to E plane, one resonator arranged in each input/output portion where X = 2 and Y = 0 | 2.05 GHz | −69 dB |

In Example No. 1-10, two resonators 2 were arranged where Z=±4 and X=Y=0 so as to be parallel to the XY plane under the conditions including a=2.2 mm and b=2.5 mm. In Example No. 1-10, the transmission intensity was −75 dB at 2.05 GHz. In the same way, in Example No. 1-11, two resonators 2 were arranged on an XY plane where Z=7.5 and two more resonators 2 were arranged on another XY plane where Z=−7.5 under the conditions including a=2.2 mm and b=2.5 mm. Each pair of resonators 2 was arranged in parallel to each other at two positions with a Y coordinate of 0 and X coordinates of −2 and 2, respectively, and the transmission intensity was −33 dB at 1.97 GHz. The following Table 8 shows the structures and characteristics of Examples Nos. 1-10 and 1-11 in comparison:

TABLE 8

| | b | Stacked spiral conductor resonator | | Pass characteristic | |
|---|---|---|---|---|---|
| | (mm) | # | Arrangement | Frequency | Transmission intensity |
| Ex. 1-10 | 2.5 | 2 | Parallel to XY plane, one resonator arranged in each input/output portion where X = 0 | 2.05 GHz | −75 dB |
| Ex. 1-11 | | 4 | Parallel to XY plane, two resonators arranged in each input/output portion where X = ±2 | 1.97 GHz | −33 dB |

In Comparative Example No. 1-5, two resonators 2 were arranged at two positions with Z coordinates of 8.2 and −8.2, respectively, parallel to the H planes under the conditions including a=2.2 mm and b=2.5 mm. Each of the resonators 2 in the input and output portions included a single pair of conductor lines, which were arranged in one column and one row at a position where X=Y=0.

In Comparative Example No. 1-5, the transmission intensity was only −79 dB, which was as low as in Comparative Example No. 1-1 where no resonators 2 were arranged at all. Thus, the beneficial effects of the present invention could not be achieved.

Next, a waveguide antenna was made as Example No. 1-12 by removing the output portion from the waveguide of Example No. 1-2. That is to say, one end of the constricted portion 8 of the waveguide was made to function as a radiation aperture to a free space. Meanwhile, a waveguide antenna in which no resonators were arranged at all was prepared as Comparative Example No. 1-6. The radiation efficiency at 2.05 GHz was 0.1% in Comparative Example No. 1-6 but 12.2% in Example No. 1-12.

Embodiment 2

Hereinafter, a second preferred embodiment of an RF circuit component according to the present invention will be described. The RF circuit component of this preferred embodiment is a slot antenna.

Figures 11A, 11B:
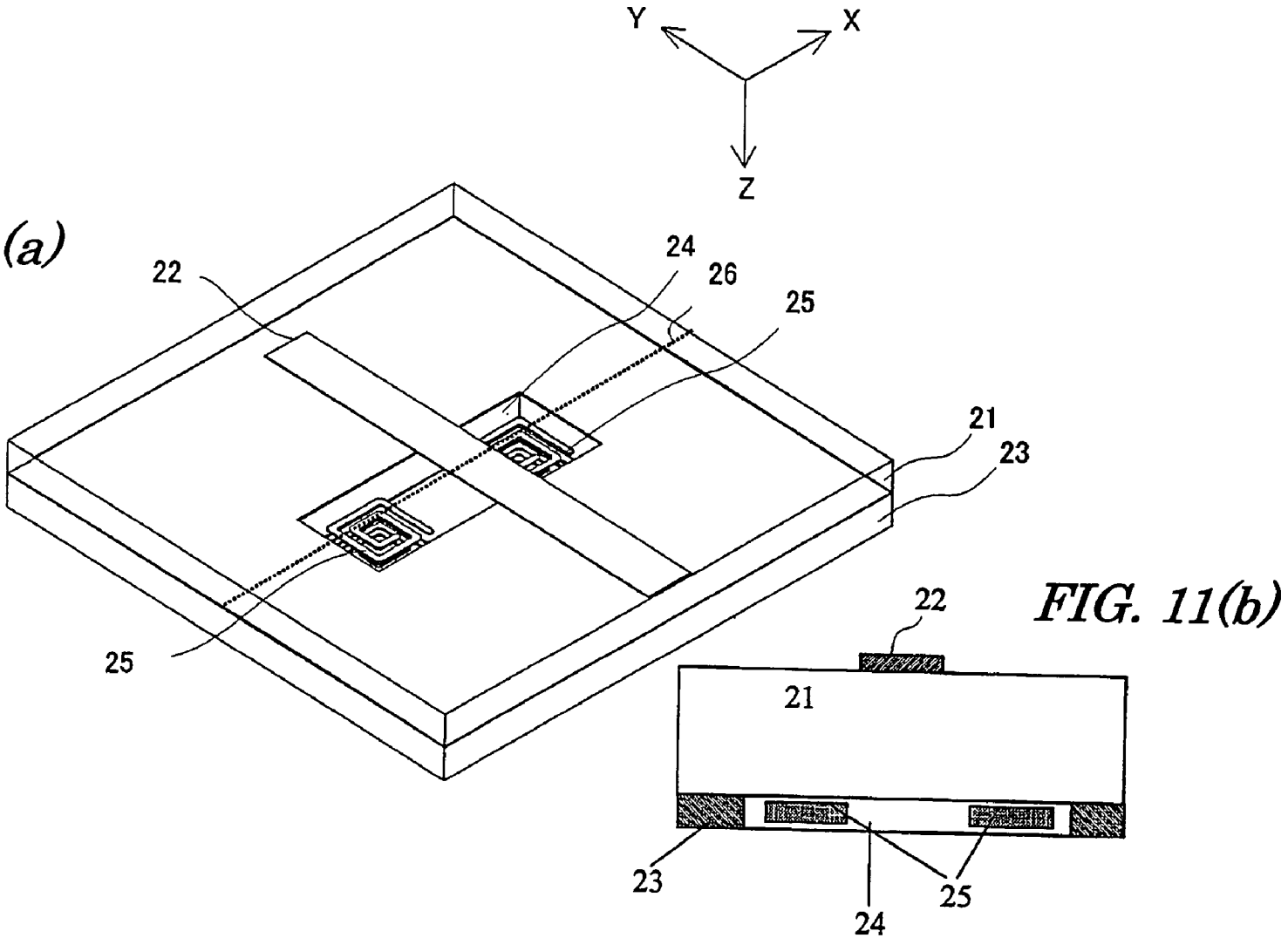
FIGS. 11(*a*) and 11(*b*) are respectively a perspective view and a cross-sectional view illustrating the configuration of a second preferred embodiment of an RF circuit component according to the present invention.
Figure 12:
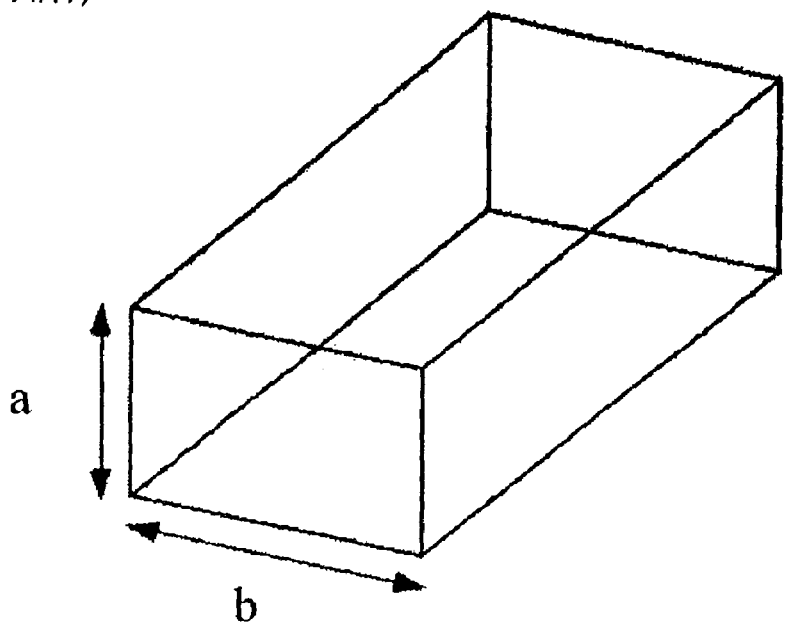
FIG. 12 (PRIOR ART)
FIG. 12 illustrates the structure of a conventional waveguide.
Figure 13:
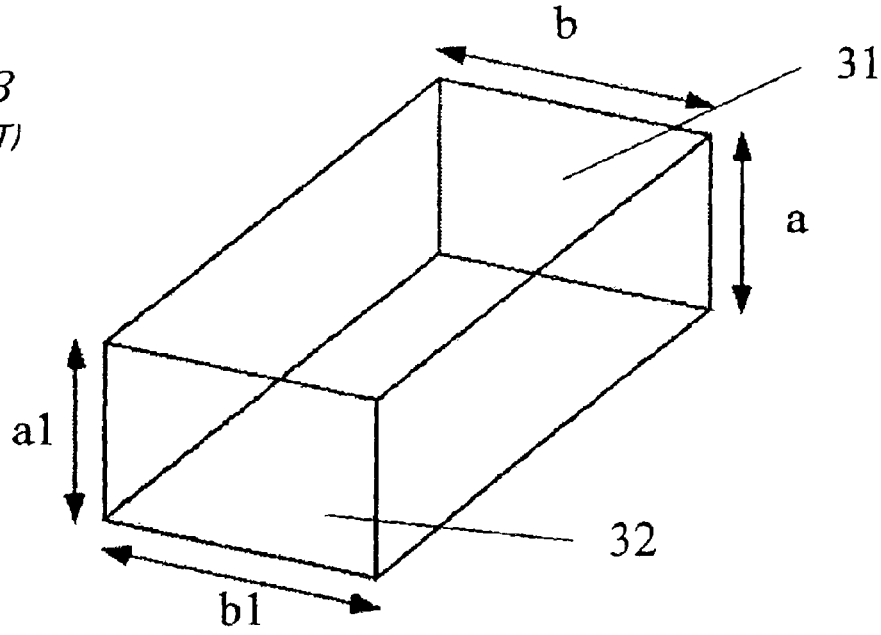
FIG. 13 (PRIOR ART)
FIG. 13 illustrates the structure of a conventional rectangular waveguide antenna.

First, referring to FIG. 11, illustrated are a perspective view showing the structure of an RF circuit component according to this second preferred embodiment in FIG. 11(*a*) and a cross-sectional view thereof as viewed on a plane indicated by the dotted line in FIG. 11(*b*), respectively. In FIG. 11, each component, which is the same as, or corresponds to, its counterpart shown in FIG. 14, is identified by the same reference numeral.

Figure 14B:
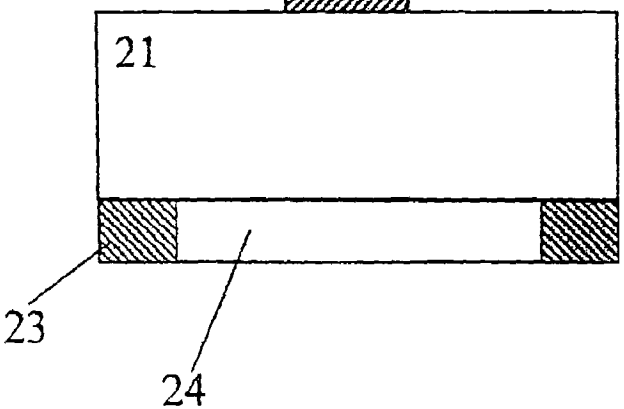
FIG. 14(b) (PRIOR ART)
FIGS. 14(*a*) and 14(*b*) are respectively a perspective view and a cross-sectional view illustrating the structure of a conventional slot antenna that should be fed with electrical power through a microstrip line.
Figure 14A:
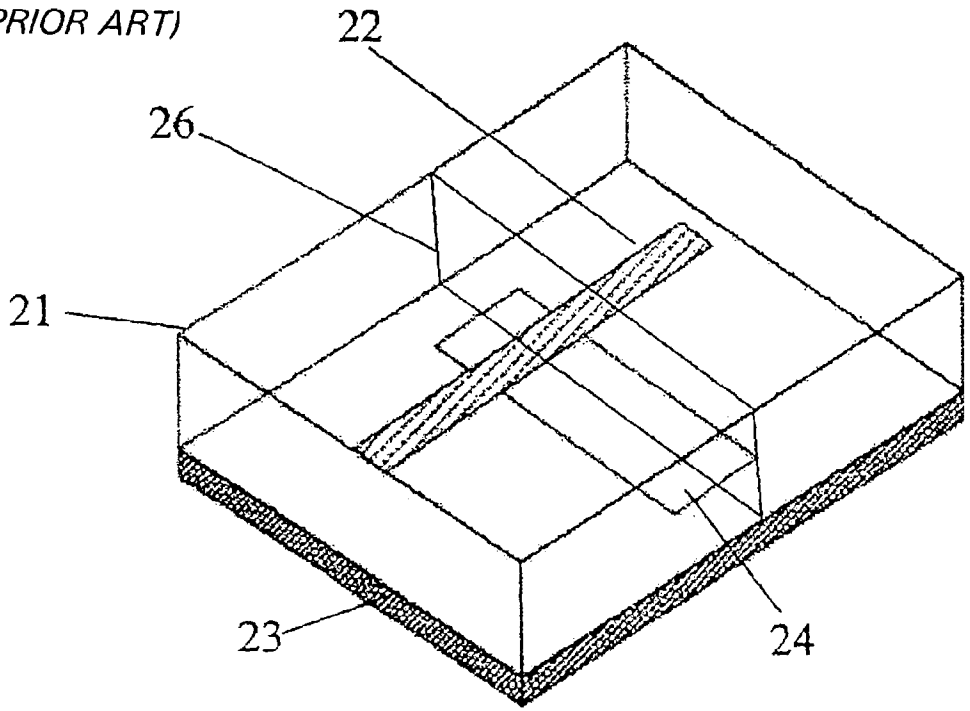
FIG. 14(a) (PRIOR ART)
Figure 15A:
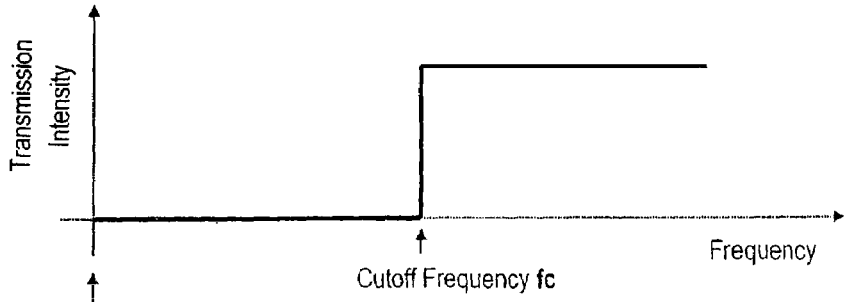
FIG. 15(a) (PRIOR ART)
FIG. 15(*a*) is a graph schematically showing how the transmission intensity of a waveguide, including an air layer inside, changes with the frequency.
Figure 15B:
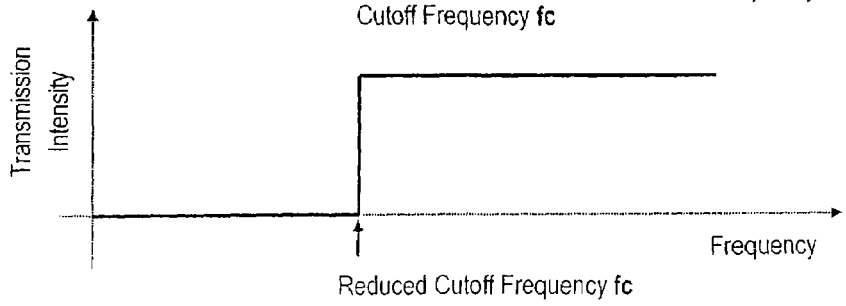
FIG. 15(b) (PRIOR ART)
Figure 15C:
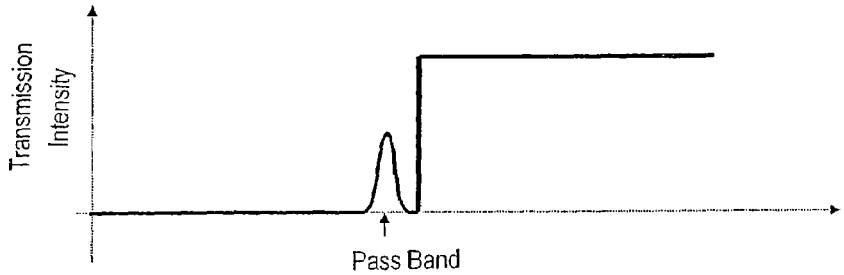
FIG. 15(c) (PRIOR ART)
Figure 15D:
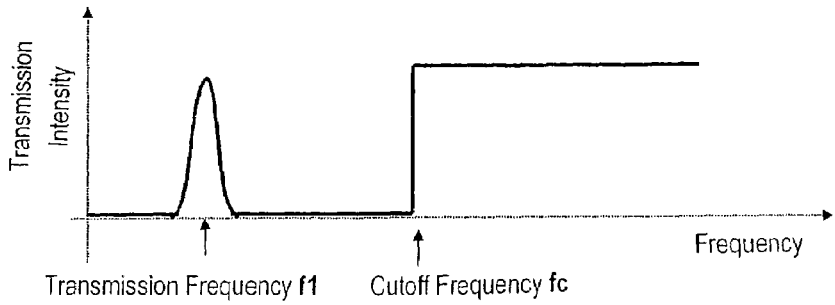

Just like the slot antenna shown in FIG. 14, the slot antenna shown in FIG. 11 also includes a dielectric substrate 21, which includes a grounded conductor layer 23 on the back surface thereof. A strip-shaped slot 24 is cut through the center of the grounded conductor layer 23. On the surface of the dielectric substrate 21, a signal conductor line 22 is provided so as to cross the slot 24 of the grounded conductor layer 23. The signal conductor line 22 and grounded conductor layer 23 forms a microstrip line, along which an electromagnetic wave propagates.

In this preferred embodiment, small resonators 25 are arranged inside or near the slot 24. The small resonators 25 may have the same structure as the resonators 2 of the first preferred embodiment described above. The small resonators 25 may be located closer to either the dielectric substrate 21 or the free space with respect to the grounded conductor layer 23. However, at least a portion of the small resonators 25 preferably overlaps with the space defined by the slot 24.

The resonant frequency f0 of the small resonators 25 for use in this preferred embodiment is adjusted to be lower than the resonant frequency determined by the horizontal width b of the slot 24. The resonant frequency of the slot 24 corresponds to the cutoff frequency fc shown in FIG. 15(*d*). In this preferred embodiment, electromagnetic waves with that resonant frequency f0 can be radiated highly efficiently thanks to the function of the small resonators 25. The electromagnetic waves with the resonant frequency f0 of the small resonators 25 have an effective wavelength that is more than twice as long as the width b of the slot 24, and therefore, should be radiated through the slot 24 into the free space with low efficiency. However, thanks to the function of the small resonators 25, electromagnetic waves, of which the effective wavelength is much longer than the horizontal width b of the slot 24, can be transmitted and received with high efficiency. The number of the small resonators 25 to provide does not have to be one but may be two or more.

In this case, the coordinate system is defined such that Y-axis is the length direction of the slot 24, X-axis is the width direction of the slot 24 and Z-axis is the radiation direction. The slot 24 has a Y-axis size of a and an X-axis size of b (where a<b). The aperture plane of the slot is aligned with an XY plane with a Z coordinate of zero, and the zero point where X=Y=0 is supposed to be located at the center of the slot 24.

The resonant frequency fc determined by the horizontal size b of the slot 24 is set higher than the transmission frequency f1 and the resonant frequency f0 of the small resonators 25. The effective wavelength of the resonant frequency fc is given by 2×b. However, the effective wavelength of the transmission frequency f1 is much greater than 2×b. Also, the size of the small resonators 25 is much smaller than the effective wavelength of the transmission frequency f1.

An electromagnetic wave can be radiated from the slot 24 that is much narrower than the conventional slot. More specifically, an electromagnetic wave, of which the frequency is one-third or less, more preferably a quarter or less, of the resonant frequency defined by the width b of the slot 24, can be radiated.

If a number of small resonators 25 are arranged according to the principle that has already been described for the first preferred embodiment, then the small resonators 25 will be coupled together, thus giving some range to the resonant frequency f0. The resonant frequency f0 of the small resonators 25 is set equal to, or close to, the transmission frequency f1. The resonators 25 may have either the same resonant frequency or mutually different resonant frequencies. From a downsizing standpoint, the number of the resonators 25 to provide is preferably two or three.

As already described for the resonators 2 of the first preferred embodiment, the small resonators 25 do not have to have the stacked spiral conductor resonator structure but may have any of various other configurations.

In arranging the resonators 25 on the aperture plane of the slot 24, the conductor layers (such as the spiral conductors) of the resonators 25 need to be arranged non-parallel to the aperture plane (i.e., the XZ plane). The aperture plane (the XZ plane) of the slot 24 is a plane defined by the length direction of the slot 24 and the electromagnetic wave radiation direction as its two axes. If the conductor layers (such as the spiral conductors) of the resonators 25 were parallel to the XZ plane, then the degree of coupling between the electromagnetic field generated inside the slot 24 and the resonators 25 would be insufficient. The resonators 25 do not have to be arranged regularly but may face various directions.

The microstrip line is not indispensable to this preferred embodiment but may be replaced with a coplanar waveguide, a grounded coplanar waveguide, a slot line or any other transmission line.

EXAMPLE 2

Hereinafter, Example Nos. 2-1 and 2-2 of an RF circuit component according to the second preferred embodiment of the present invention will be described.

A dielectric substrate 21 made of a resin material with a dielectric constant of 3.9 and a thickness of 250 μm was prepared, and a signal conductor line 22 was provided on its surface as a gold line with a width of 500 μm and a thickness of 20 μm. Meanwhile, the entire back surface of the dielectric substrate 21, except an area where the slot would be cut, was plated with gold to a thickness of 50 μm, thereby forming a grounded conductor layer 23.

In this example, the slot 24 of the grounded conductor layer 23 had a rectangular shape with a horizontal width of 6 mm and a vertical length of 2.4 mm. And the origin where X=Y=0 was defined at the center of the slot 24. The open end of the signal conductor line 22 was 5 mm away from the origin where X=Y=0. The back surface of the dielectric substrate 21 was aligned with the XY plane with a Z coordinate of zero. That is to say, a space with positive Z coordinates was the free space where electromagnetic waves were radiated.

As Example No. 2-1, the resonator 25 was arranged on a plane that was parallel to the E plane (i.e., the YZ plane). The resonator 25 included spiral conductors in a square area with a size of 2 mm each side. Each spiral conductor had a line width of 0.2 mm, a number of times of spiral turns of two, and a minimum spacing of 0.2 mm between the conductor lines. Such spiral conductor lines were stacked one upon the other so as to turn in mutually opposite directions and have a stacking gap of 0.15 mm. The resonator 25, obtained as a stack of spiral conductors by cross-coupling these two spiral conductors together, had a resonant frequency of 4.07 GHz by itself.

Two resonators 25 with such a configuration were prepared and arranged on both sides of the signal conductor line 22 such that one resonator 25 was located on each side. Each resonator 25 was positioned such that its center was located at a point where Z=−1. That is to say, the resonator 25 was located within the dielectric substrate 21 where −0.25<Z<0 but located in the air where Z<−0.25 and Z>0. The centers of the resonators 25 were set at positions where Y=0 and X=1.5 and −1.5, respectively.

Example No. 2-1 caused a return loss of 7 dB, a gain of 5 dBi and a radiation efficiency of 46.2% at 4.07 GHz. On the other hand, Comparative Example No. 2-1, obtained by removing the resonators 25 from Example No. 2-1, caused a return loss of 0.2 dB, a gain of −2.21 dBi and a radiation efficiency of 14.9% at 4.07 GHz. Comparing these results, it can be seen that a significant difference was made in radiation efficiency.

The frequency of the electromagnetic wave radiated from the antenna of Example No. 2-1 was one-third or less of the resonant frequency of the slot 24.

Example No. 2-2 in which the conductor layers of each resonator 25 were arranged parallel to the XY plane was made by modifying the RF circuit component of Example No. 2-1 in which the conductor layers of each resonator 25 were arranged parallel to the E plane (i.e., the YZ plane).

In Example No. 2-2, two resonators 25 were arranged on both sides of the signal conductor line 22 such that one resonator 25 was located on each side. More specifically, the resonators 25 were arranged such that the respective centers of the spiral conductor lines of the two resonators 25 were located at X=1.7 mm and X=−1.7 mm, respectively. In the Z-axis direction, the resonators 25 were positioned such that the gap between the resonators 25 was all filled with a resin but that one of the two resonators 25 faced the radiation plane. Each of the resonators 25 had a resonant frequency of 2.77 GHz.

Example No. 2-2 caused a return loss of 2.8 dB, a gain of 0.77 dBi and a radiation efficiency of 32.9% at 2.77 GHz. On the other hand, Comparative Example No. 2-1, obtained by removing the resonators 25 from Example No. 2-2, caused a return loss of 0.1 dB, a gain of −10.6 dBi and a radiation efficiency of 3.82% at 2.77 GHz. Comparing these results, it can be seen that a significant difference was made in radiation efficiency. The frequency of the electromagnetic wave radiated from the antenna of Example No. 2-2 was 1/4.5 or less of the resonant frequency of the slot 24.

Comparative Example No. 2-2 in which the conductor layers of each resonator 25 were arranged parallel to the H plane (i.e., XZ plane) was made by modifying the RF circuit component of Example No. 2-2 in which the conductor layers of each resonator 25 were arranged parallel to the XY plane. The radiation characteristics of Comparative Example No. 2-2 were the same as those of Comparative Example No. 2-1. The following Table 9 summarizes the structures and characteristics of Examples Nos. 2-1 and 2-2 and Comparative Examples Nos. 2-1 and 2-2 in comparison:

TABLE 9

| | Stacked spiral conductor resonator | | Radiation characteristic | | | |
|---|---|---|---|---|---|---|
| | # | Arranged | Frequency | Reflection loss | Gain | Radiation efficiency |
| Ex. 2-1 | 2 | Parallel to E plane (YZ plane) | 4.07 GHz | 7 dB | 5 dBi | 46.2% |
| Ex. 2-2 | 2 | Parallel to XY plane | 2.77 GHz | 2.8 dB | 0.77 dBi | 32.9% |
| Cmp. Ex. 2-1 | 0 | — | 4.07 GHz | 0.2 dB | −2.21 dBi | 14.9% |
| | | | 2.77 GHz | 0.1 dB | −10.6 dBi | 3.82% |
| Cmp. Ex. 2-2 | 2 | Parallel to H plane (XZ plane) | 2.77 GHz | 0.1 dB | −10.6 dBi | 3.82% |

Optionally, if the number of layers stacked in each resonator 25 is increased, then the electromagnetic waves can be radiated at even lower frequencies.

As described above, the RF circuit component of the present invention arranges small resonators, of which the resonant frequency f0 is close to the transmission frequency f1, inside the waveguide, thereby making it possible to pass electromagnetic waves that would otherwise be cut off. This means that the resonators arranged inside the waveguide cause the effect of substantially increasing the dielectric constant and permeability in the inner space of the waveguide. Consequently, the electromagnetic waves can be transmitted through the waveguide that has a narrower cross section than a conventional one.

Thanks to the function of those resonators (i.e., the effects of substantially increasing the dielectric constant and permeability), electromagnetic waves can be radiated efficiently from a waveguide antenna that has a narrower aperture than a conventional one.

An RF circuit component according to the present invention can make electromagnetic waves propagate through a waveguide that has a far narrower cross section than a conventional one, and can be used effectively as a small waveguide. The RF circuit component may also be used as a small waveguide antenna for radiating and sensing electromagnetic waves.

That is why the RF circuit component of the present invention and an RF circuit including the RF circuit component are broadly applicable to filters, antennas, sensors and demultiplexers in the fields of communications and analysis. The RF circuit component and RF circuit may also be used in apparatuses that utilize the power transmission technology or RF transmission technology using an IC tag, for example.

While the present invention has been described with respect to preferred embodiments thereof, it will be apparent to those skilled in the art that the disclosed invention may be modified in numerous ways and may assume many embodiments other than those specifically described above. Accordingly, it is intended by the appended claims to cover all modifications of the invention that fall within the true spirit and scope of the invention.

What is claimed is:

1. An RF circuit component comprising a waveguide and at least one resonator, which is arranged inside the waveguide, wherein the resonator includes at least one patterned conductor layer, which is parallel to a plane that crosses an H plane, and resonates at a lower frequency than a cutoff frequency that is defined by the internal dielectric constant, shape and size of the waveguide, thereby letting an electromagnetic wave, having a lower frequency than the cutoff frequency, pass through the inside of the waveguide.

2. The RF circuit component of claim 1, wherein the resonant frequency of the resonator is equal to or lower than a quarter of the cutoff frequency.

3. The RF circuit component of claim 1, wherein the at least one resonator is a plurality resonators.

4. The RF circuit component of claim 3, wherein the resonators have different resonant frequencies.

5. The RF circuit component of claim 1, wherein the patterned conductor layer includes at least one of a spiral conductor line, a partially notched ring-shape conductor line, a spiral slot, and a partially notched ring-shape slot.

6. The RF circuit component of claim 5, wherein the resonator operates as a half-wavelength resonator or a quarter-wavelength resonator.

7. The RF circuit component of claim 5, wherein the at least one patterned conductor layer is a plurality of conductor layers, and wherein the conductor layers are stacked one upon the other and cross-coupled together.

8. The RF circuit component of claim 7, wherein the resonator has a stacked spiral conductor resonator structure.

9. The RF circuit component of claim 1, wherein the at least one patterned conductor layer is a plurality of conductor layers, which are stacked one upon the other, and wherein two adjacent ones of the conductor layers have spiral shapes that turn in mutually opposite directions.

10. The RF circuit component of claim 1, wherein the at least one resonator is a plurality resonators, which are arranged in the waveguide so as to face mutually different directions.

11. The RF circuit component of claim 10, wherein at least one of the resonators is arranged such that the patterned conductor layer thereof becomes parallel to a plane other than the H plane of the waveguide.

12. The RF circuit component of claim 1, wherein the waveguide has a pair of opposed metal walls, and wherein the pair of metal walls is connected together via a conductive member.

13. An RF circuit comprising more than one RF circuit component of claim 1, wherein the RF circuit components include a first RF circuit component that transmits an electromagnetic wave at a first frequency, and a second RF circuit component that transmits an electromagnetic wave at a second frequency, which is different from the first frequency, and wherein the RF circuit multiplexes together electromagnetic waves with the first and second frequencies or demultiplexes an electromagnetic wave into two waves with the first and second frequencies, respectively.

14. An RF circuit comprising the RF circuit component of claim 1, wherein the waveguide included in the RF circuit component functions as an antenna for radiating or receiving an electromagnetic wave.

* * * * *